US005460539A

United States Patent [19]

Gallone

[11] Patent Number: 5,460,539

[45] Date of Patent: Oct. 24, 1995

[54] CONNECTING DEVICE FOR ELECTRIC COMPONENTS

[76] Inventor: Cesare Gallone, 3, Queens Keep, Upper Park Road, Camberley, Surrey, United Kingdom

[21] Appl. No.: 271,435

[22] Filed: Jul. 7, 1994

[30] Foreign Application Priority Data

Dec. 7, 1993 [IT] Italy ..... MI93A1525

[51] Int. Cl.[6] ..... H01R 4/24

[52] U.S. Cl. ..... 439/425; 439/417

[58] Field of Search ..... 439/425, 417, 439/419, 611, 617, 619

[56] References Cited

U.S. PATENT DOCUMENTS

| | | | |
|---|---|---|---|
| 3,859,554 | 1/1975 | Preziosi et al. | 313/315 |
| 4,631,650 | 12/1986 | Ahroni | 362/249 |
| 4,768,139 | 8/1988 | Poppenheimer | 362/302 |
| 5,121,310 | 6/1992 | Ahroni | 362/238 |
| 5,172,026 | 12/1992 | Hall et al. | 313/318 |
| 5,252,888 | 10/1993 | Topel et al. | 313/318 |

*Primary Examiner*—Larry I. Schwartz
*Assistant Examiner*—Jill DeMello
*Attorney, Agent, or Firm*—Kolisch, Hartwell, Dickinson, McCormack & Heuser

[57] ABSTRACT

In an electric connecting device, a pair of conductors (3) is engaged in respective anchoring seats (3) formed in one connecting portion (6) provided with a coupling bush (17) to be coaxially engaged by sliding on a guide collar (18) associated with a second connecting portion (10). Suitable fitting lugs (25, 27) associated with the guide collar (18) cooperate with coupling slots (26, 28) formed in the bush (17) for mutually fastening the first and second connecting portions (6, 10) to an operating condition in which the electric connecting elements (11) shaped as piercing points and integral with the first portion diametrically cross the terminal ends (3*a*) of the conductors (3) housed in the anchoring seats (7) for coming into close contact with the conductor cores (4).

14 Claims, 2 Drawing Sheets

FIG 3
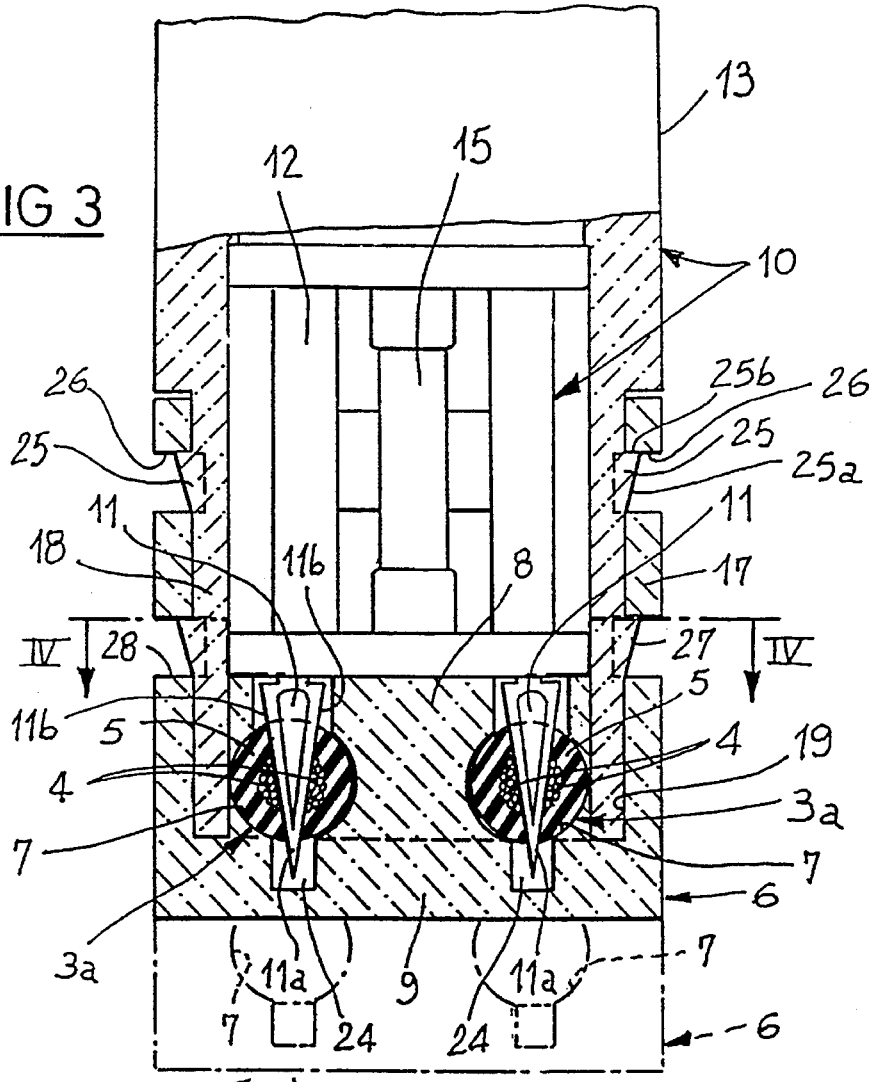
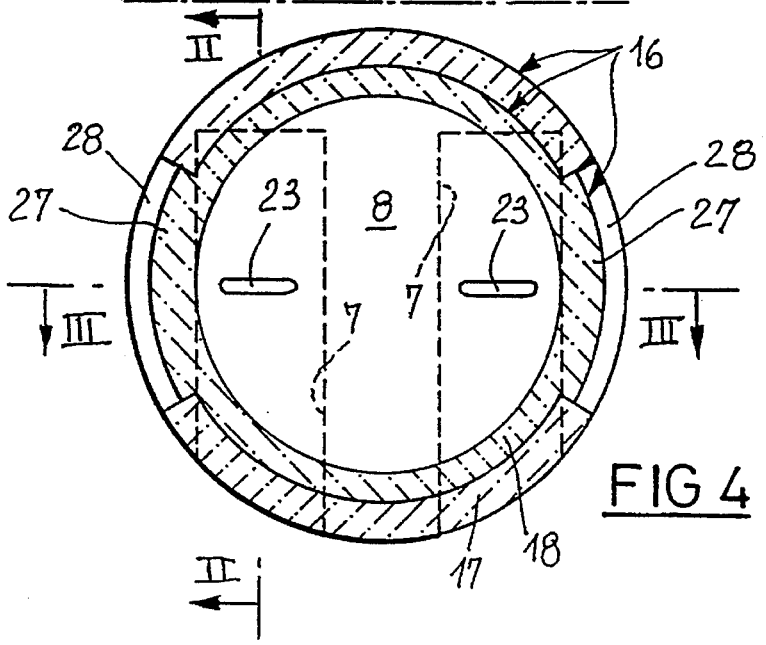
FIG 4

CONNECTING DEVICE FOR ELECTRIC COMPONENTS

The present invention relates to a connecting device for electric components, of the type comprising: one connecting portion carrying anchoring seats arranged to house respective terminal ends of electric conductors, each exhibiting a core made of conductive material strands covered with an insulating sheath; a second connecting portion carrying electric connecting elements each arranged to electrically connect the core of one of said conductors to one of said electric components; engagement means for mutually fastening the first and second connecting portions in an operating condition in which said electric connecting elements act in contact relationship on the cores of the respective conductors across said insulating sheaths.

In the embodiment to which reference will be particularly made in the course of the present description the connecting device aims at electrically connecting bulb microlamps, of the type used for signal lights in electrical apparatus and the like. However it is understood that the device in question can also be conceived for uses different from the described one.

It is known that connection of electric and/or electronic components to respective electric conductors can be presently made following different modalities.

According to a first system it is essentially provided that the electric or electronic component be equipped with appropriate terminals to which the ends of the respective conductors are secured by welding, upon removal of the insulating sheath coating said ends.

The execution of this method involves many difficulties above all with reference to small-sized and mass-produced electric or electronic components where the connection of the wires is required to be carried out in a completely automated manner and within a very short period of time.

According to another known connecting method, suitable connectors may be associated with the electric conductor ends through a mere clasping operation, said connectors being adapted to be engaged by forced fitting on corresponding terminals associated with the electric or electronic component to be connected.

This solution has undoubted advantages as compared to the execution of a welding, but suffers from some drawbacks too, such as the necessity of carrying out different workings for removing the insulating sheath from the conductor ends and fastening the connectors thereto.

It is also to be noted that with the use of the above described connectors operations for engaging each conductor to the respective terminal take place independently of each other. This situation involves important technical difficulties when in automated processes such engagement operations must be carried out simultaneously for the purpose of reducing the working time.

There are also connecting devices enabling the connection of all conductors associated with an electric or electronic component to be carried out simultaneosly in a single operation, without requiring removal of the insulating sheath from the ends of the individual conductors.

These devices essentially comprise one connecting portion usually made of plastic material in which a plurality of anchoring seats is formed, each being designed to house the terminal end of a respective conductor. Combined with the first connecting portion is a second connecting portion that, by engagement means usually of the snug-fitting type, lends itself to be fastened to the first portion in a predetermined operating condition.

The second connecting portion rigidly carries a plurality of electric connecting elements that are suitably connected to the electric or electronic component before or after assembling of the connecting device. Each of these electric connecting elements having substantially a plate-like structure exhibits a substantially fork-shaped active portion that, on engagement of the first and second connecting portions in the operating condition, exerts pressure against the end of one of the conductors so as to cut the insulating sheath at diametrically opposite locations, coming thereby into contact with the conductor core consisting of strands of conductive material.

It has been found however that also in the connecting devices of this type the resistance of the connection to tractive efforts carried out on the conductors is not completely satisfactory, even if important costs are involved. It may in fact happen that under the effect of tractive forces the insulating sheath cut off at the electric connecting element gets torn over the whole section thereof, the core formed of the conductive strands being consequently pulled away from the electric connecting element itself. In other cases it may happen that, still under the effect of tractive efforts transmitted from the conductors, one or more of the electric connecting elements bend at their active portions and disengage from the conductors themselves.

It is also to be pointed out that the electric connecting elements used in this type of connecting devices have a transverse extension necessarily greater than the diametrical sizes of the conductors. Therefore, when connection of a plurality of conductors disposed consecutively in side by side relation is to be carried out, it is necessary to arrange the individual electric connecting elements in several rows conveniently spaced apart from each other; as a result, the connecting device will be very bulky.

The object of the present invention is substantially to overcome the drawbacks of the known art by providing a connecting device that not only enables the electric connection to be carried out on the ends of insulated conductors in a very pratical and easy manner, but also ensures an excellent resistance to the tractive efforts transmitted by the conductors and in addition has very reduced sizes, is not very expensive and can be easily mounted.

The foregoing and further objects that will become more apparent in the course of the present description are substantially achieved by a connecting device for electric components, characterized in that each of said electric connecting elements is shaped as a piercing point substantially oriented in a fitting direction perpendicularly intersecting the longitudinal axis of the respective anchoring seat, and extends, in the operating condition, in the anchoring seat itself through an access opening defined in the first connecting portion, engaging one end thereof in a retaining recess defined within the anchoring seat on the side opposite to the access opening, said engagement means comprising a guide collar and a coupling bush associated with the first and second connecting portions respectively, to be coaxially engaged by mutual sliding parallelly to said fitting direction, so that said conductors are diametrically crossed by the respective electric connecting elements in the operating condition.

Further features and advantages will become more apparent from the detailed description of a preferred embodiment of a connecting device for electric components in accordance with the invention, given hereinafter by way of non-limiting example with reference to the accompanying drawings, in which:

FIG. 3 shows the device in question in operating conditions, sectioned along line III—III in FIG. 4;

FIG. 4 shows the device sectioned along the line IV—IV in FIG. 3.

Figures 1, 2:
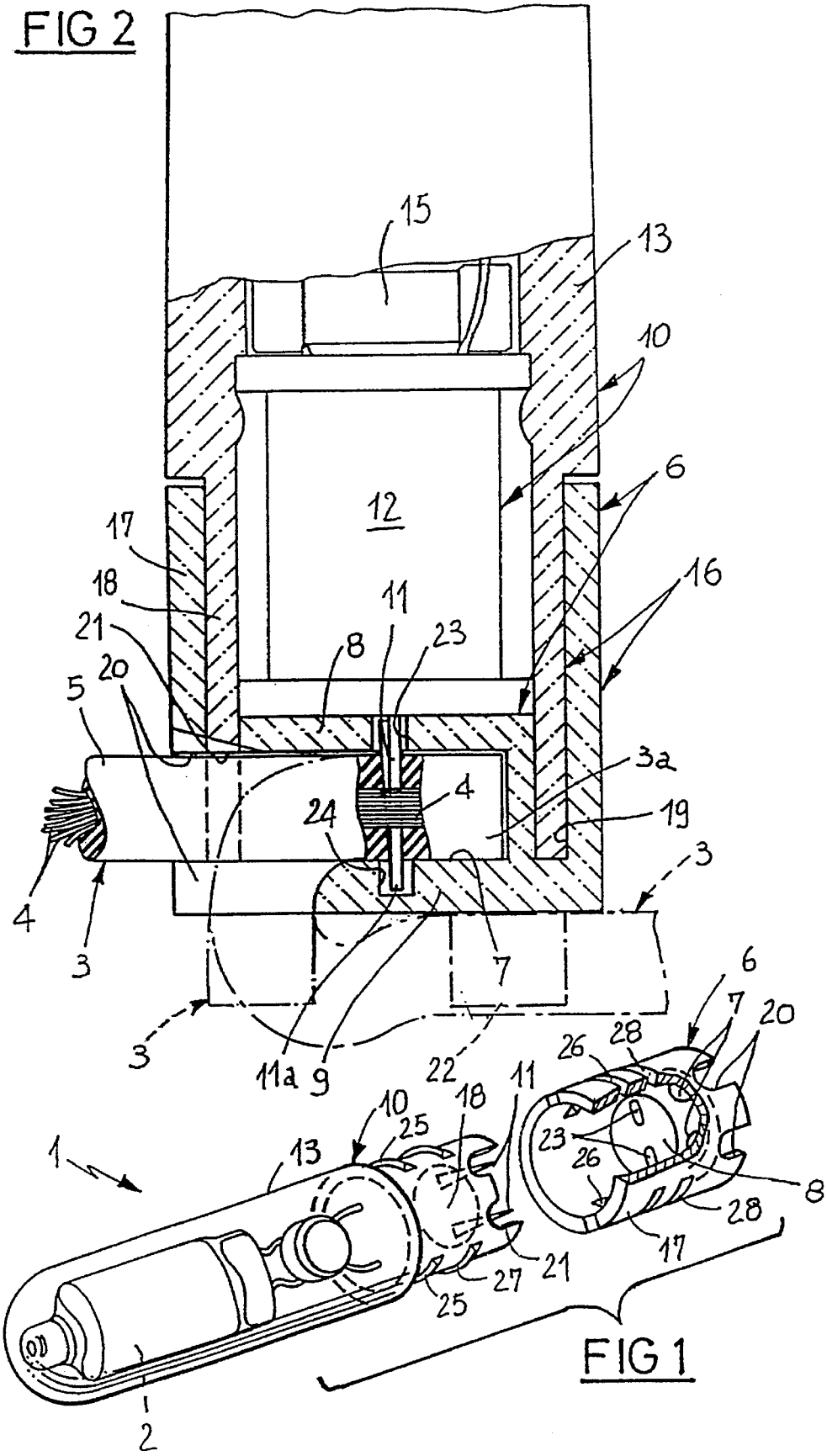
FIG. 1 is a perspective view of the device in question in a disassembled condition, associated with a bulb microlamp.
FIG. 2 is a part sectional view of the device in question, taken along line II—II in FIG. 4.

Referring to the drawings, a connecting device for electric components in accordance with the invention has been generally identified by reference numeral 1.

In the embodiment shown the connecting device 1 is associated with a bulb microlamp 2 known per se and conventional, for enabling connection of said lamp with a pair of conductors 3 each of which conventionally has a core 4 consisting of strands made of copper or other conductive material, surrounded by an insulating sheath 5.

The device 1 comprises one connecting portion generally denoted by 6, exhibiting one or more anchoring seats 7 each designed to house a terminal end 3*a* of one of the electric conductors 3.

In greater detail, in the case shown the presence of two of said anchoring seats 7 is provided and they are disposed parallel in side by side relation preferably within a central small base 8 of cylindrical conformation, rising from a base wall 9 of said first connecting portion 6.

Advantageously, the shape of each of the anchoring seats 7 matches that of the terminal end 3*a* of the corresponding conductor 3 so that each seat completely encloses said terminal end and is in contact relationship with the outer surfaces thereof. In other words, the anchoring seats 7 have a diameter only marginally greater than the outer diameter of the insulating sheaths of the conductors 3, for the purposes to be clarified in the following.

Combined with the first connecting portion 6 is a second connecting portion generally identified by 10, carrying one or more electric connecting elements 11 each arranged to electrically connect the core 4 of one of the conductors 3 to the microlamp 2 or other electric components with which the device 1 is associated.

In the embodiment shown, the second connecting portion 10 comprises a supporting block 12 in which said electric connecting elements 11 are engaged by a snug-fitting operation carried out in known manner.

This supporting block is rigidly housed, by snug-fitting for example, within a containing capsule 13 preferably made of transparent plastic material, inside which the microlamp 2 is located The supporting block 12 may also engage, in a manner known per se, one or more electric resistors 15 operatively interposed between the electric connecting elements 11 and the bulb microlamp 2.

In an original manner, in accordance with the present invention, each of the electric connecting elements 11 is shaped as a piercing point substantially oriented in a fitting direction perpendicularly intersecting the longitudinal axis of the respective anchoring seat 7, to the ends better clarified in the following.

More particularly, each electric connecting element 11 has a substantially plate-like structure, lying in a plane perpendicular to the longitudinal axis of the respective anchoring seat 7 having a wedge-shaped profile defined by two side edges 11*b* converging away from the supporting block 12 as far as they meet at one end 11*a* of the electric connecting element.

An engagement means 16 is associated with the first and second connecting portions 6, 10 and arranged to fix the mutual positioning of said connecting portions in an operating condition in which, as better described in the following, the electric connecting elements 11 operatively act in contact relationship on the cores 4 of the respective conductors 3.

Advantageously, said engagement means 16 essentially comprises a coupling bush 17 and a guide collar 18 associated with the first and second connecting portions 6, 10 respectively and susceptible of being coaxially engaged with each other by mutual sliding parallell to the fitting direction of each electric connecting element 11. In more detail, the guide collar 18 is formed with one end of said containing capsule 13 and the coupling bush 17 projects perpendicularly from the perimetric edge of the base wall 9 of the first connecting portion 6, encircling said central small base 8. As clearly shown in FIGS. 2 and 3, an annular groove 19 is defined between the central small base 8 and coupling bush 17, the end of the guide collar 18 being housed, in the operating condition, in said groove.

Advantageously, defined in the coupling bush 17 and guide collar 18 are first and second side ports 20, 21, respectively, that are located in alignment with the anchoring seats 7 and designed to be passed through by the conductors 3 emerging from the anchoring seats. Preferentially, the first side ports 20 also extend close to the base wall 9 of the first connecting portion 6, so that the conductors 3 may be oriented at least in a direction substantially parallel to the fitting direction, as shown by chain line in FIG. 2. The presence of hooking elements 22 (also shown in chain line in FIG. 2) is also provided and they are associated with the base wall 9 for holding the conductors 3 according to an orientation opposite to the respective terminal ends 3*a* introduced into the anchoring seats 7.

In accordance with the present invention, the engagement between the guide collar 18 and coupling bush 17 enables the mutual movement of the first and second connecting portions 6, 10 from a preparatory arrangement condition in which they are mutually spaced apart as shown in chain line in FIG. 3, to said operating condition is which the first and second connecting portions are disposed close to each other, as shown in solid line.

In the preparatory arrangement condition, the ends 11*a* of the electric connecting elements 11 are disengaged from the respective anchoring seats 7 so that the terminal ends 3*a* belonging to the corresponding conductors 3 can be fitted therein. In more detail, in the preparatory arrangement condition the ends 11*a* of the electric connecting elements 11 are located in respective access openings 23 defined in the central small base 8 of the first connecting portion 6.

When the first and second connecting portions 6, 10 are mutually moved to the operating condition, the electric connecting elements 11 diametrically cross the terminal ends 11*a* of the corresponding conductors 3 piercing the insulating layer or sheath 5 and dividing the strands forming the core 4 into two groups for engaging their ends 11*a* in corresponding retaining recesses 24 defined in the base wall 9, within each anchoring seat 7, on the side opposite to the respective access opening 23.

In the inserting condition, therefore, the conductive strands forming the core 4 of each conductor 3 are in close contact with the diverging side edges 11*b* of the electric connecting elements 11 thereby ensuring an excellent electric continuity therewith.

Following the introduction of the electric connecting elements 11 into and through the terminal ends 3*a* of the conductors 3, the terminal ends undergo a deformation involving a side expansion counteracted by the inner surfaces of the corresponding anchoring seats 7 that, as previously described, are in a contact relationship on the insulating sheaths 5 already in the preparatory arrangement condition. This situation further ensures the close contact and electric continuity between the cores 4 of the conductors 3 and the electric connecting elements 11.

In order to fix the mutual positioning of the first and second connecting portions 6, 10 to the operating condition, at least one first fitting lug 25 and at least one first coupling slot 26 are provided to be associated with the engagement means 16 and they are formed on the guide collar 18 and coupling bush 17 respectively, so as to be mutually engaged by snap fitting, as clearly shown in FIG. 3. More particularly, in the embodiment shown the presence of a pair of said first fitting lugs 25 and coupling slots 26 is provided.

Each first fitting lug 25 has an inclined slide side 25*a* at which forced sliding of the coupling bush 17 moving towards the operating condition, occurs. The inclined side 25*a* is followed by an abutment shoulder 25*b* designed to act on an edge of the coupling slot 26 when the fitting lug 25 snaps therein on reaching of the operating condition.

Preferably, also formed on the guide collar 18 is at least one second fitting lug 27 suitably spaced apart from the first fitting lugs 25 with reference to the insertion direction. More particularly, the presence of a pair of said second fitting lugs 27 i s provided and each of them engages one of the first coupling slots 26 for fixing the mutual positioning of the first and second connecting portions 6, 10 to the preparatory arrangement condition, in the same manner as described with reference to the first fitting lugs 25. This situation appears to be very advantageous for facilitating introduction of the terminal ends 3*a* of the conductors 3 into the respective anchoring seats 7, above all when the connecting operation is carried out by automated machines.

It is also advantageously provided that at least one second coupling slot 28 be formed in the coupling bush 17. In the embodiment shown there are two second coupling slots 28, suitably spaced apart from the first slots 26 with reference to the insertion direction, each of which being designed to operatively engage one of the second fittinq lugs 27, as shown in FIG. 3, for helping the action of the first fitting lugs 25 in mutual fastening of the first and second connecting portions 6, 10 in the operating condition.

The modalities of use of the present invention described above mainly as regards structure are very simple.

The device 1 is preassembled to the preparatory arrangement condition by a mere operation consisting in fitting the coupling bush 17 on the guide collar 18.

Under this situation, the connecting operation for enabling current supply to the microlamp 2 only requires that the terminal ends 3*a* of the conductors 3 be introduced into the anchoring seats 7, stripping being unnecessary. Since the anchoring seats 7 are oriented parallel to each other, insertion of the conductors 3 can be easily carried out by a single operation.

Once the insertion is executed, the only operation to be done is pushing the first connecting portion 6 to the operating condition for causing the simultaneous connection of the conductors 3 to the microlamp 2, as a result of the conductors themselves being passed through by the electric connecting elements 11.

The present invention attains the intended purposes.

It is in fact to be noted that in addition to greatly simplifying the connecting operations, the device in question is capable of ensuring an excellent connecting strength in terms of tractive efforts that may be imposed to the conductors 3.

In the connection it is in fact to be noted that the electric connecting elements, while having very reduced sizes, are not subjected to bending under the effect of said tractive efforts, in that their ends 11*a* are conveniently held in the respective retaining recesses 24.

In addition tractive stresses that would tend to make the conductor ends come out of the anchoring seats 7 are conveniently counteracted by the adhesion created between the outer surfaces of the insulating sheaths 5 and inner surfaces of the anchoring seats, following the forced expansion undergone by the terminal ends 3*a* when the electric connecting elements 11 are introduced thereinto.

It is also to be noted that due the conformation of the electric connecting elements 11 in the form of a piercing point, tearing inevitably produced on the insulating sheaths 5 is greatly reduced as compared to cases in which known devices are used. This aspect too considerably helps in improving the mechanical strength of the connection.

In addition, the use of electric connecting elements in the form of a piercing point enables the side dimensions of said electric connecting elements to be greatly reduced, which brings about an important reduction in the bulkiness of the whole device as compared to the devices of the known art, above all with reference to connections in which the conductors: connected side by side to each other through the respective insulating layers, form a single ribbon-like structure. Under this situation, the present invention enables arrangement in a single plane of as many electric connecting elements 11 as the conductors to be connected, unlike the solutions of the known art where due to the greater bulkiness of the electric connecting elements, their distribution in offset rows is required.

Obviously many modifications and variations may be made to the invention as conceived, all falling within the scope of the appended claims.

It is claimed and desired to secure by letters patent:

1. A connecting device for connecting an electric component to electrical conductors, comprising:

one connecting portion (6) carrying anchor seats (7) arranged to house respective terminal ends (3*a*) of electric conductors (3), each conductor exhibiting a core (4) made of conductive-material strands covered with an insulating sheath (5);

a second connecting portion (10) carrying electric connecting elements (11) each arranged to electrically connect the core (4) of one of said conductors (3) to the electric component (2);

engagement means (16) for mutually fastening the first and second connecting portions (6, 10) in an operating condition in which said electric connecting elements (11) act in contact relationship on the cores (4) of the respective conductors (3) across said insulating sheaths (5), characterized in that each of said electric connecting elements (11) is shaped as a piercing point substantially oriented in a fitting direction perpendicularly intersecting the longitudinal axis of the respective anchoring seat (7), and extends, in the operating condition, in the anchoring seat itself through an axis opening (23) defined in the first connecting portion (6), said engagement means (16) comprising a guide collar (18) and a coupling bush (17) associated with the first and second connecting portions (6, 10) respectively, to be coaxially engaged by mutual sliding parallelly to said fitting direction, so that said conductors (3) are diametrically crossed by the respective electric connecting elements (11) in the operating condition.

2. A device according to claim 1, characterized in that each of said anchoring seats (7) completely encloses a conductor end and is in contact relationship with the conductor end, so that the insulating sheath (5) arranged on the conductor is expanded by effect of the insertion of the electric connecting element (11) across the conductor (3) and acts in thrust relationship on the inner surfaces of the anchoring seats 7 in the operating condition.

3. A device according to claim 1, characterized in that said engagement means (16) further comprises at least one first fitting lug (25) and at least one coupling slot (26), formed in the guide collar (18) and coupling bush (17) respectively, and capable of mutual engagement by snap fitting so as to fix the first and second connecting portions (6, 10) in the operating condition.

4. A device according to claim 3, characterized in that the device further comprises at least one second fitting lug (27) spaced apart from the first fitting lug (25) and arranged to be engaged by snap fitting in said first coupling slot (26) for fixing the first and second connecting portions (6, 10) in a preparatory arrangement condition in which said electric connecting elements (11) are disengaged from the anchoring seats (7) for enabling introduction of the ends (3*a*) of the respective conductors (3) thereinto.

5. A device according to claim 4, characterized in that the device further comprises at least one second coupling slot (28) spaced apart from the first coupling slot (26) and arranged to engage said second fitting lug (27) by snap fitting in the operating condition.

6. A device according to claim 4, characterized in that in the preparatory arrangement condition the ends (11*a*) of the electric connecting elements (11) are located in register with said access openings (23).

7. A device according to claim 1, characterized in that said second connecting portion (10) comprises a supporting block (12) from which said electric connecting elements (11) project and a containing capsule (13) exhibiting said guide collar (18) at one end thereof and internally engaging the supporting block (12), a bulb microlamp (2) housed in the containing capsule (13) being engaged to said supporting block (12) on the opposite side with respect to the electric connecting elements (11) and being electrically connected to the connecting elements themselves.

8. A device according to claim 7, characterized in that said first connecting portion (6) comprises a base wall (9) and a central small base (8) projecting from the base wall (9) and encircled by said coupling bush (17), said anchoring seats (7) being formed within the central small base (8).

9. A device according to claim 8, characterized in that said coupling bush (17) has first side ports (20) located in alignment with said anchoring seats (7) and arranged to be crossed by the conductors (3) emerging from the anchoring seats in the extension of the corresponding terminal ends (3*a*).

10. A device according to claim 9, characterized in that said first side ports (20) stretch out at said base wall (9) in order to enable orientation of said conductors (3) at least in a direction substantially parallel to the insertion direction.

11. A device according to claim 10, characterized in that it further comprises hooking elements (22) associated with said base wall (9), arranged to engage the conductors (3) emerging from the anchoring seats (7) and hold them according to an orientation opposite to the respective terminal ends (3*a*).

12. A device according to claim 8, characterized in that an annular groove (19) is defined between said central small base (8) and coupling bush (17) for housing one end of the guide collar (18), in the operating condition.

13. A device according to claim 11, characterized in that the end of the guide collar (18) exhibits second side ports (21) located in alignment with said anchoring seats (7) and arranged to be crossed by the conductors (3) emerging from the anchoring seats (7) in the extension of the respective terminal ends (3*a*).

14. A connecting device for connecting an electric component to electrical conductors comprising:

one connecting portion carrying anchoring seats arranged to house respective terminal ends of the electrical conductors and a second connecting portion having electric connecting elements with each arranged to electrically connect one of said conductors to the electric component, one connecting portion having a guide collar and the second connecting portion having a coupling bush and the guide collar and bush being coaxially engaged by mutual sliding in a direction extending axially of the bush and collar, each of said electric connecting elements being shaped as a piercing point oriented in a direction which extends perpendicularly of the anchoring seats and being positioned to engage a conductor end occupying an anchor seat with relative movement of the collar and bush in said axial direction so that the conductor is diametrically crossed by the connecting element.

* * * * *